US011537076B1

(12) United States Patent
Sugiyama

(10) Patent No.: US 11,537,076 B1
(45) Date of Patent: Dec. 27, 2022

(54) SUPPORT DEVICE

(71) Applicant: TOSHIBA TEC KABUSHIKI KAISHA, Tokyo (JP)

(72) Inventor: Ryota Sugiyama, Fuji Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/389,538

(22) Filed: Jul. 30, 2021

(51) Int. Cl.
*G03G 15/00* (2006.01)
*B65D 81/05* (2006.01)

(52) U.S. Cl.
CPC ..... *G03G 15/65* (2013.01); *B65D 81/05* (2013.01)

(58) Field of Classification Search
CPC ..... B65H 81/107
See application file for complete search history.

(56) References Cited

FOREIGN PATENT DOCUMENTS

| | | |
|---|---|---|
| JP | 2002-274591 | 9/2002 |
| JP | 5174475 B2 * | 4/2013 |
| JP | 2017-197235 | 11/2017 |

* cited by examiner

*Primary Examiner* — Jennifer Bahls
(74) *Attorney, Agent, or Firm* — Amin, Turocy & Watson, LLP

(57) ABSTRACT

According to one embodiment, provided is a support device including a base member, a pair of tip members, and a pair of lower end members. The base member is configured to be foldable at an intermediate portion in a width direction, the base member having a plate shape. The pair of tip members are present in both end portions of the base member in the width direction and have a configuration where a pair of plate materials are disposed to be tapered. The pair of lower end members have a plate shape, are present in a lower end portion of the base member on both sides of the base member in a thickness direction, and form a substantially right angle with the base member.

20 Claims, 9 Drawing Sheets

SUPPORT DEVICE

FIELD

Embodiments described herein relate generally to a support device.

BACKGROUND

A large capacity paper feeding device that supplies many sheets to an image forming apparatus is used. In a cassette of the large capacity paper feeding device, a tray where sheets are stacked is present. The tray can move up and down. If the large capacity paper feeding device is packaged and conveyed, a support device that supports the trays is disposed in the cassette. In the support device, it is required to restrict movement of the tray.

DETAILED DESCRIPTION

According to one embodiment, provided is a support device including a base member, a pair of tip members, and a pair of lower end members. The base member is configured to be foldable at an intermediate portion in a width direction, the base member having a plate shape. The pair of tip members are present in both end portions of the base member in the width direction and have a configuration where a pair of plate materials are disposed to be tapered. The pair of lower end members have a plate shape, are present in a lower end portion of the base member on both sides of the base member in a thickness direction, and form a substantially right angle with the base member.

Hereinafter, a support device according to an embodiment will be described.

The support device according to the embodiment supports a tray present in a bottom portion of a cassette of a large capacity paper feeding device. The large capacity paper feeding device supplies sheets to an image forming apparatus. The image forming apparatus, the large capacity paper feeding device, and the support device according to the embodiment will be sequentially described.

Figure 1:
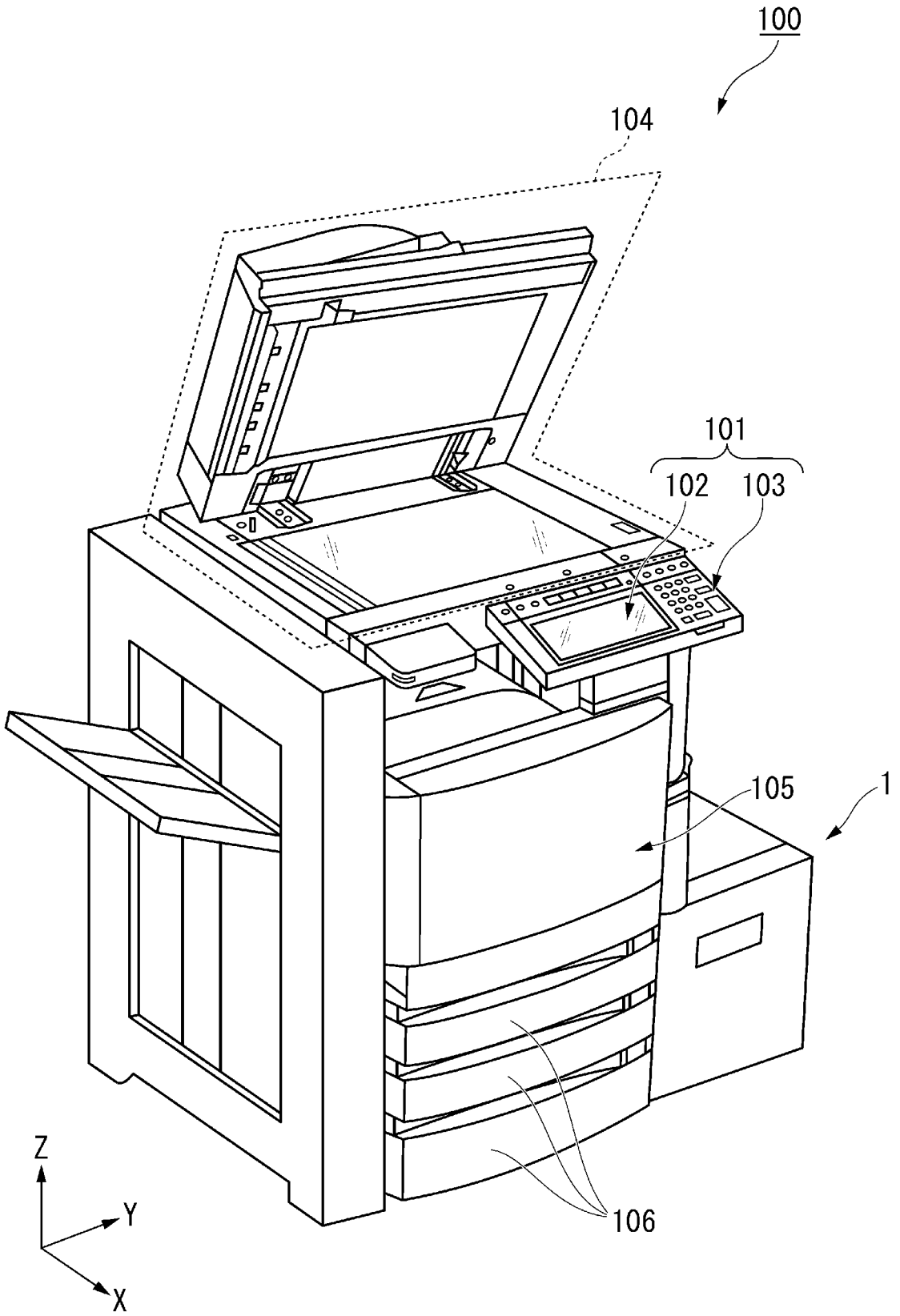
FIG. 1 is a perspective view illustrating an image forming apparatus and a large capacity paper feeding device.

FIG. 1 is a perspective view illustrating the image forming apparatus and the large capacity paper feeding device.

In the present application, a Z direction, an X direction (third direction), and a Y direction (fourth direction) in the rectangular coordinate system are defined as follows. The Z direction is a vertical direction (up-down direction) and a +Z direction is an upward direction. The X direction and the Y direction are horizontal directions. The X direction is a front-rear direction of an image forming apparatus 100, and a +X direction is a front direction. The Y direction is a left-right direction of the image forming apparatus 100, and a +Y direction is a right direction. The right direction of the image forming apparatus 100 is a right direction when the image forming apparatus 100 is seen from the front side to the rear side. In the present application, the respective directions of the image forming apparatus 100 including the upward, downward, front, rear, right, and left directions will be simply referred to as "up, down, front, rear, right, and left".

The image forming apparatus 100 will be described.

The image forming apparatus 100 forms an image on a sheet with a developer such as a toner. The image forming apparatus 100 includes an operation unit 101, a scanner unit 104, a printer unit 105, and a cassette paper feed unit 106.

The operation unit 101 includes a display 102 and a control panel 103. The display 102 displays various information regarding the image forming apparatus 100. The control panel 103 includes a plurality of buttons. The control panel 103 receives an operation of a user. In addition, the control panel 103 outputs a signal corresponding to the operation input by the user to a control unit of the image forming apparatus 100.

The scanner unit 104 reads image information of a reading target based on brightness and darkness of light. The scanner unit 104 outputs the read image information to the printer unit 105.

The printer unit 105 forms an image on the sheet based on image information generated by the scanner unit 104 or image information received through a communication path.

The cassette paper feed unit 106 accommodates the sheet to be used for forming the image in the printer unit 105 in the cassette. The cassette paper feed unit 106 supplies the sheet accommodated in the cassette to the printer unit 105.

A large capacity paper feeding device 1 will be described in detail.

The large capacity paper feeding device 1 can accommodate more sheets than the cassette paper feed unit 106. For example, the large capacity paper feeding device 1 is disposed adjacent to the right side of the image forming apparatus. An opening through which sheets supplied from the large capacity paper feeding device 1 are received is provided on the right side of the image forming apparatus 100.

Figure 2:
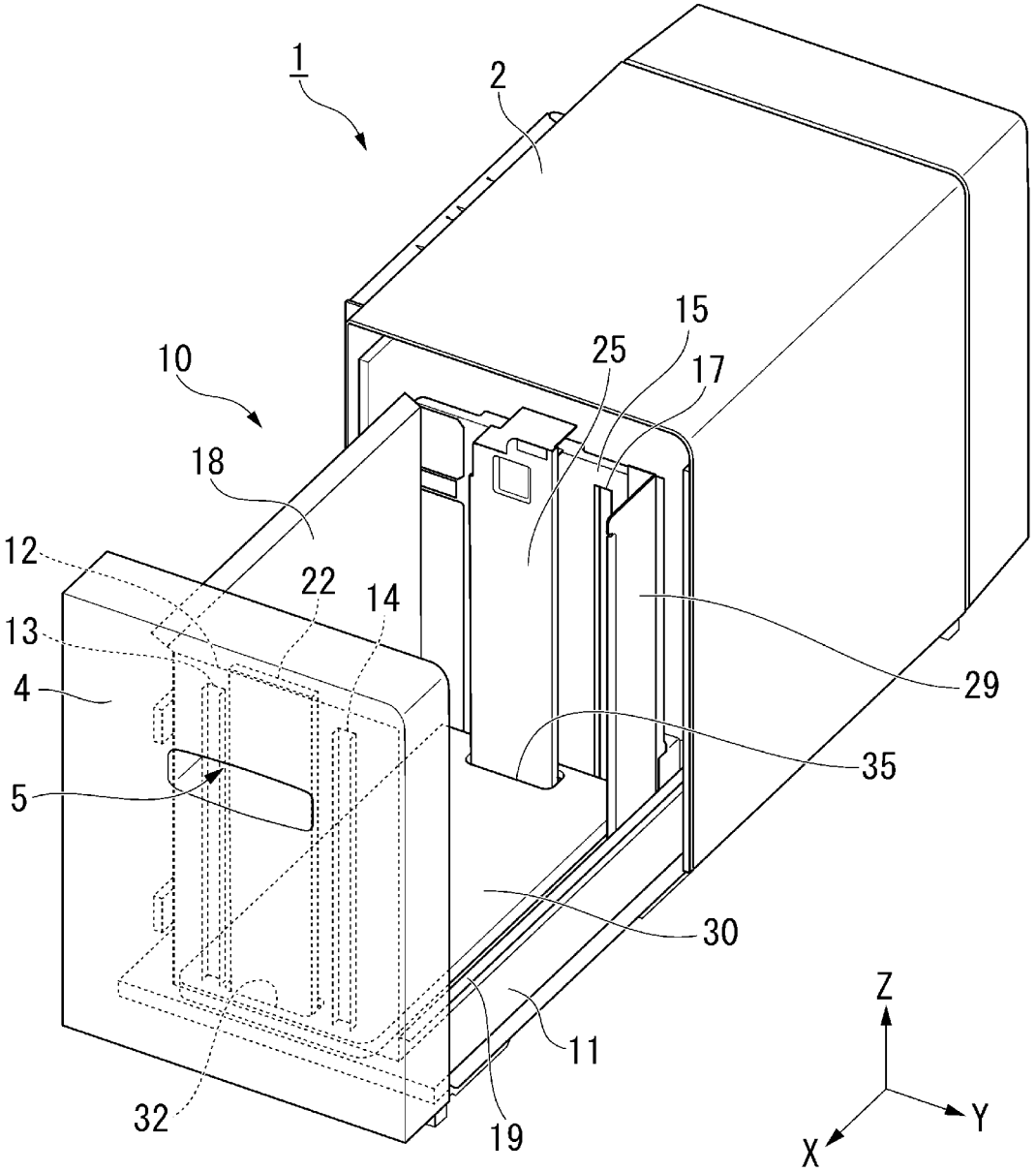
FIG. 2 is a perspective view illustrating a state where a cassette of the large capacity paper feeding device is drawn.

FIG. 2 is a perspective view illustrating a state where the cassette of the large capacity paper feeding device is drawn. The large capacity paper feeding device 1 includes a case 2, a front cover 4, and a cassette 10.

The case 2 covers a part of the large capacity paper feeding device 1 other than a front surface. An opening through which the sheet is discharged is provided above a left surface of the case 2.

The front cover 4 covers the front surface of the large capacity paper feeding device 1. The front cover 4 includes a handle 5 to be used for moving the cassette 10.

The cassette 10 is fixed to the back of the front cover 4 and can be accommodated in the case 2. The cassette 10 is movable in the front-rear direction relative to the case 2 together with the front cover 4. The cassette 10 includes a bottom frame 11, a pair of first frames 12 and 15, and a pair of second frames 18 and 19.

The bottom frame 11 is present in the bottom portion of the cassette 10. The bottom frame 11 is parallel to the XY plane.

The pair of first frames 12 and 15 are parallel to the YZ plane. The pair of first frames 12 and 15 face each other in the front-rear direction. The pair of first frames 12 and 15 are a front frame 12 and a rear frame 15. The front frame 12 is present on the front side of the cassette 10. The rear frame 15 is present on the rear side of the cassette 10.

The pair of second frames 18 and 19 are parallel to the XZ plane. The pair of second frames 18 and 19 face each other in the left-right direction. The pair of second frames 18 and 19 are a left frame 18 and a right frame 19. The left frame 18 is present on the front side of the cassette 10. The right frame 19 is present on the rear side of the cassette 10.

The heights of the front frame 12, the rear frame 15, and the left frame 18 are the same as each other and are higher than the right frame 19. The upper side and the right side of the cassette 10 are opened. The sheet is inserted from the upper side and the right side of the cassette 10 into the cassette 10. The sheet inserted into the cassette 10 is disposed parallel to the XY plane on the upper surface of a tray 30.

The cassette 10 includes a sheet position adjustment mechanism 20. The sheet position adjustment mechanism 20 adjusts the position of the sheet in the cassette 10 according to the size of the sheet. The sheet position adjustment mechanism 20 includes a front guide 22, a rear guide 25, and a right guide 29. A left end of the sheet abuts against the left frame 18.

The front guide 22 and the rear guide 25 abut against a front end and a rear end of the sheet and adjust the positions of the front end and the rear end of the sheet. The front guide 22 and the rear guide 25 are long in the up-down direction. The front guide 22 and the rear guide 25 are present at intermediate portions of the cassette 10 in the left-right direction. The front guide 22 is present on the front side of the cassette 10 and the rear side of the front frame 12. A rear surface of the front guide 22 is parallel to the YZ plane and abuts against the front end of the sheet. The rear guide 25 is present on the rear side of the cassette 10 and the front side of the rear frame 15. A front surface of the rear guide 25 is parallel to the YZ plane and abuts against the rear end of the sheet. The front guide 22 and the rear guide 25 are provided to be movable relative to the bottom frame 11 in the front-rear direction. The front guide 22 and the rear guide 25 may be linked to each other. If the front guide 22 moves to the rear side by a predetermined distance, the rear guide 25 may move to the front side by the predetermined distance.

The right guide 29 abuts against the right end of the sheet and adjusts the position of the right end of the sheet. The right guide 29 is long in the up-down direction. The right guide 29 is present at a rear end of the cassette 10. The right guide 29 is present on the right side of the cassette 10 and the left side of the right frame 19. A left surface of the right guide 29 is parallel to the XZ plane and abuts against the right end of the sheet. The right guide 29 is provided to be movable relative to the bottom frame 11 in the left-right direction.

The cassette 10 includes the tray 30. The tray 30 is present above the bottom frame 11. The sheet inserted into the cassette 10 is disposed on the upper surface of the tray 30.

Figure 3:
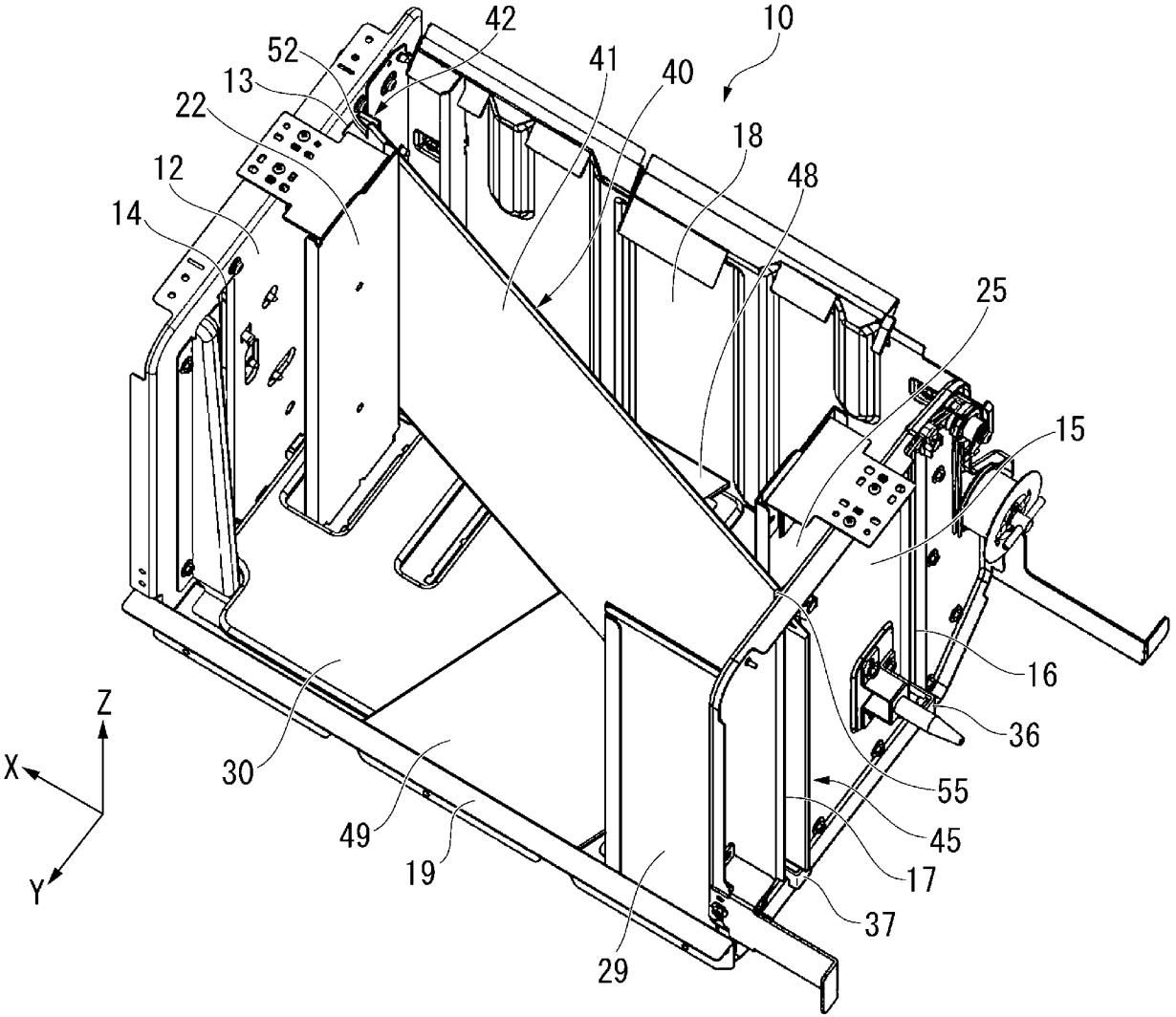
FIG. 3 is a perspective view illustrating a state where the support device is mounted on the large capacity paper feeding device.
Figure 9:
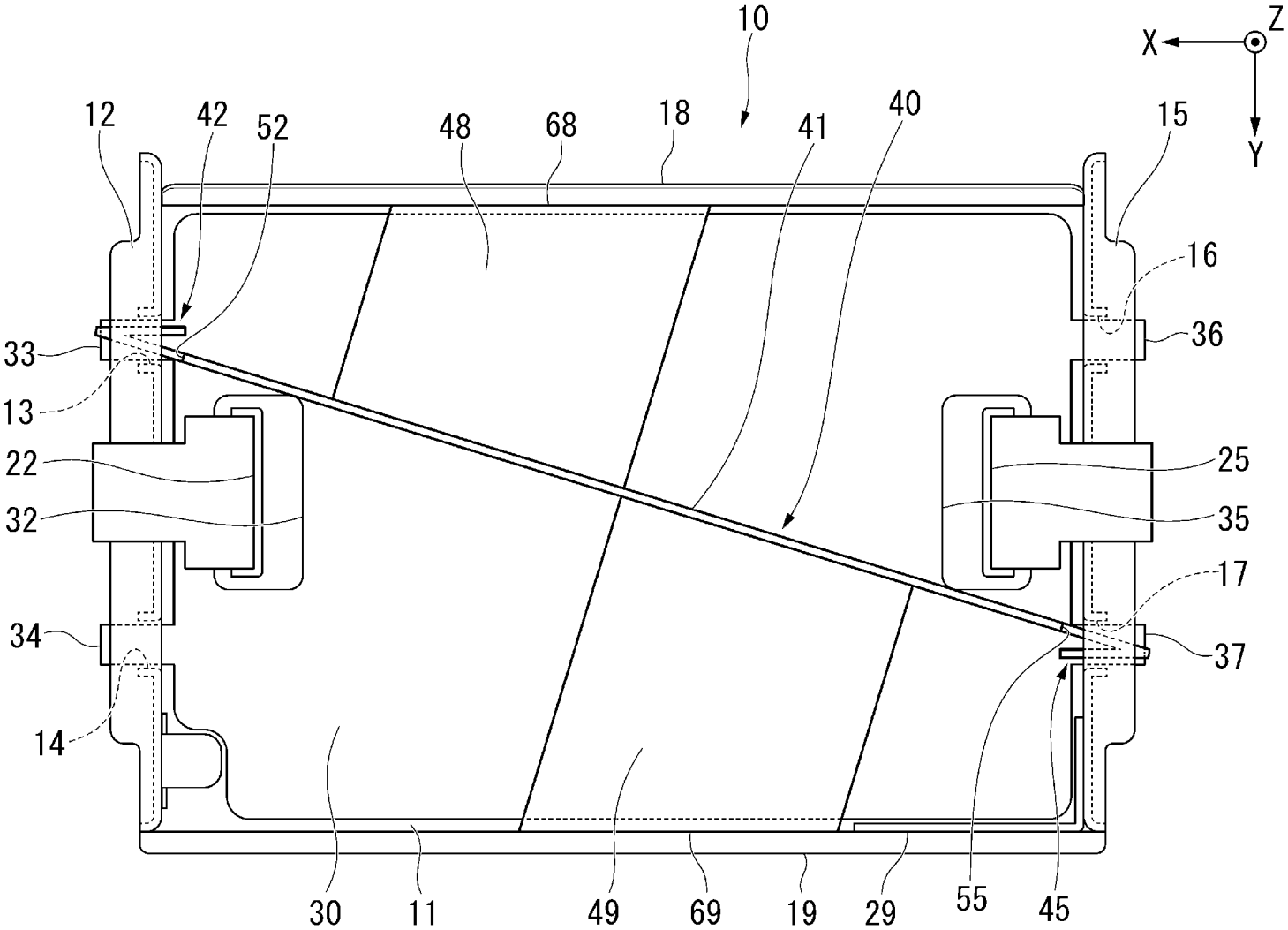
FIG. 9 is a fourth diagram illustrating the method of mounting the support device on the cassette.

FIG. 3 is a perspective view illustrating a state where the support device according to the embodiment is mounted on the large capacity paper feeding device, and FIG. 9 is a plan view thereof. The tray 30 has a flat plate shape and is parallel to the XY plane. The tray 30 has a front guide hole 32 and a rear guide hole 35. The front guide 22 is disposed in the front guide hole 32. The rear guide 25 is disposed in the rear guide hole 35.

As illustrated in FIG. 9, the tray 30 includes a pair of front pins 33 and 34 and a pair of rear pins 36 and 37. The pair of front pins 33 and 34 and the pair of rear pins 36 and 37 are connected to the tray 30. The pair of front pins 33 and 34 protrude to the front side from the front end of the tray 30. The pair of front pins 33 and 34 approach the left end and the right end of the tray 30. The pair of rear pins 36 and 37 protrude to the rear side from the rear end of the tray 30. The pair of rear pins 36 and 37 approach the left end and the right end of the tray 30.

The front frame 12 includes a pair of front hole portions 13 and 14. The pair of front hole portions 13 and 14 are long in the up-down direction. The pair of front hole portions 13 and 14 penetrate the front frame 12 in the front-rear direction. The pair of front pins 33 and 34 are inserted into the pair of front hole portions 13 and 14. The rear frame 15 includes a pair of rear hole portions 16 and 17. The pair of rear hole portions 16 and 17 are long in the up-down direction. The pair of rear hole portions 16 and 17 penetrate the rear frame 15 in the front-rear direction. The pair of rear pins 36 and 37 are inserted into the pair of rear hole portions 16 and 17.

Tips of the pair of front pins 33 and 34 are present on the front side of the front frame 12. Tips of the pair of rear pins 36 and 37 are present on the rear side of the rear frame 15. Wires are connected to the tips of the pair of front pins 33 and 34 and the pair of rear pins 36 and 37. If a motor winds the wires, the tray 30 moves up. If the motor unwinds the wires, the tray 30 moves down. If the cassette 10 is drawn from the case 2 illustrated in FIG. 2, the tray 30 moves down due to its own weight. As the method of moving down the tray 30, two patterns including the self-weight downward movement and the motor control are present. If the tray moves down due to its own weight, a centrifugal brake works, and thus fracture or the like caused by falling does not occur. The pair of front hole portions 13 and 14 and the pair of rear hole portions 16 and 17 illustrated in FIG. 9 guide the vertical movement of the tray 30.

The case 2 illustrated in FIG. 2 includes a paper feeding mechanism. The paper feeding mechanism is present on the upper left side in the case 2. The paper feeding mechanism is present in a center portion of the case 2 in the front-rear direction. The paper feeding mechanism includes, for example, a pickup roller, a paper feed roller, and a separation roller. The sheet is disposed on the upper surface of the tray 30, and the cassette 10 is accommodated in the case 2. The motor moves up the sheet together with the tray 30. The paper feeding mechanism picks up the sheet from the tray 30 one by one and supplies the sheet to the image forming apparatus 100.

The support device will be described in detail.

As illustrated in FIGS. 3 and 9, if the large capacity paper feeding device 1 is packaged and conveyed, a support device 40 is disposed in the cassette 10 and supports the tray 30.

Figure 4:
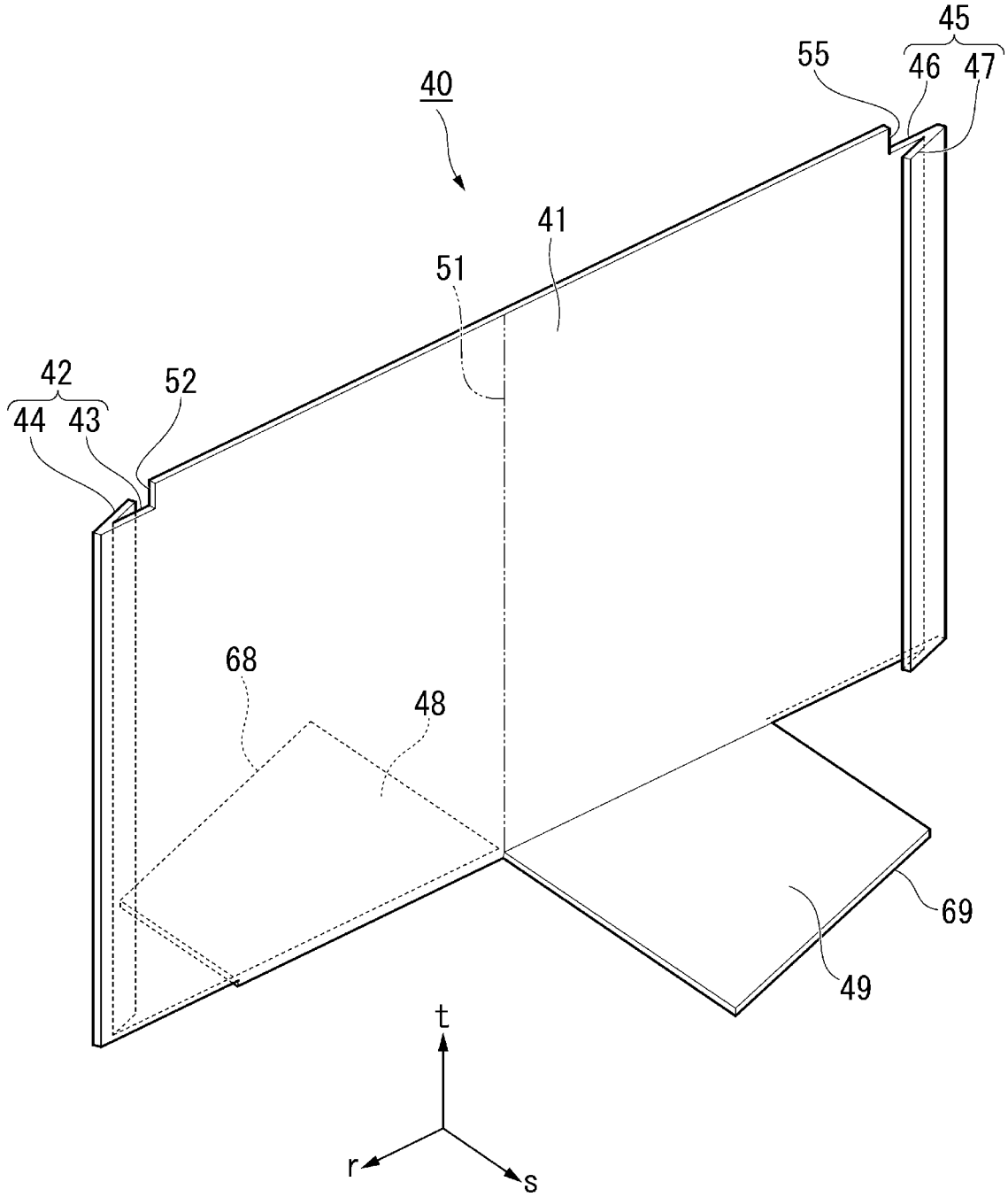
FIG. 4 is a perspective view illustrating a support device.

FIG. 4 is a perspective view illustrating the support device. The support device 40 is formed using cardboard, thick paper, or the like. The support device 40 includes a base member 41, a pair of tip members 42 and 45, and a pair of lower end members 48 and 49.

In the present application, as a local coordinate system of the support device 40, a r direction, a s direction, and a t direction in the rectangular coordinate system are defined. The r direction is a width direction of the base member 41. A +r direction (first direction) is a direction that forms an acute angle with the front direction, and a −r direction (second direction) is a direction opposite to the +r direction. The s direction is a thickness direction of the base member 41, and a +s direction is a direction that forms an acute angle with the right direction. The t direction is a height direction of the base member 41, and a +t direction is a direction that forms an acute angle with the upward direction. For example, the t direction is parallel to the up-down direction (Z direction).

The base member 41 has a quadrangular plate shape. The base member 41 is foldable at a polygonal line 51 of an intermediate portion in the width direction. The polygonal line 51 is a center portion of the base member 41 in the width direction. The polygonal line 51 is present between the pair of lower end members 48 and 49.

The pair of tip members 42 and 45 are both end portions of the base member 41 in the width direction. The pair of tip members 42 and 45 are long in the t direction. A cross-sectional shape perpendicular to the t direction of the pair of tip members 42 and 45 is constant. A height from a lower end portion to an upper end portion of the base member 41 is higher than a height from the lower end portion of the base member 41 to upper end portions of the pair of tip members 42 and 45. A pair of step portions 52 and 55 are present between the upper end portion of the base member 41 and the upper end portions of the pair of tip members 42 and 45. The pair of tip members 42 and 45 are a first tip member 42 and a second tip member 45.

The first tip member 42 is an end portion of the base member 41 in the +r direction. The first tip member 42 is tapered toward the tip in the +r direction. In the first tip member 42, a pair of plate materials 43 and 44 are disposed to be tapered. The pair of plate materials 43 and 44 are a base end plate material 43 and a tip plate material 44. An end portion of the base endplate material 43 in the −r direction is continuous with an end portion of the base member 41 in the +r direction. The base end plate material 43 is present on the same rt plane as the base member 41. An end portion of the base end plate material 43 in the +r direction is continuous with an end portion of the tip plate material 44 in the +r direction. The tip plate material 44 is present in a −s direction of the base end plate material 43. The tip plate material 44 may be present in the +s direction of the base end plate material 43.

The second tip member 45 is an end portion of the base member 41 in the direction. The second tip member 45 is tapered toward the tip in the −r direction. In the second tip member 45, a pair of plate materials 46 and 47 are disposed to be tapered. The pair of plate materials 46 and 47 are a base end plate material 46 and a tip plate material 47. An end portion of the base member 41 in the −r direction is continuous with an end portion of the base end plate material 46 in the +r direction. The base end plate material 46 is present on the same rt plane as the base member 41. An end portion of the base end plate material 46 in the −r direction is continuous with an end portion of the tip plate material 47 in the −r direction. The tip plate material 47 is present in the +s direction of the base end plate material 46. The tip plate material 47 may be present in the −s direction of the base end plate material 46.

The tip plate material 44 of the first tip member 42 and the tip plate material 47 of the second tip member 45 are opposite to each other in the s direction with respect to the base member 41.

The pair of lower end members 48 and 49 have a quadrangular plate shape. The pair of lower end members 48 and 49 are present in the lower end portion of the base member 41. The pair of lower end members 48 and 49 are present on both sides in the s direction with respect to the base member 41. The pair of lower end members 48 and 49 forma substantially right angle with the base member 41. The pair of lower end members 48 and 49 are substantially parallel to the rs plane. The pair of lower end members 48 and 49 are a first lower end member 48 and a second lower end member 49.

The first lower end member 48 is present in the +r direction and the −s direction of the base member 41. An end portion of the first lower end member 48 in the −r direction is present at a center portion of the base member 41 in the r direction. An end portion of the first lower end member 48 in the +r direction is present in the −r direction further than the end portion of the base member 41 in the +r direction.

The second lower end member 49 is present in the −r direction and the +s direction of the base member 41. An end portion of the second lower end member 49 in the +r direction is present at a center portion of the base member 41 in the r direction. An end portion of the second lower end member 49 in the −r direction is present in the +r direction further than the end portion of the base member 41 in the −r direction.

A tip side 68 of the first lower end member 48 and a tip side 69 of the second lower end member 49 are parallel to each other. The tip side 68 of the first lower end member 48 and the tip side 69 of the second lower end member 49 are not parallel to the base member 41 and intersect with the r direction. A length in the s direction from a lower end side of the base member 41 to an end portion of the tip side 69 of the second lower end member 49 in the −r direction is longer than a length in the s direction from the lower end side of the base member 41 to an end portion of the tip side 68 of the first lower end member 48 in the +r direction.

Figure 5:
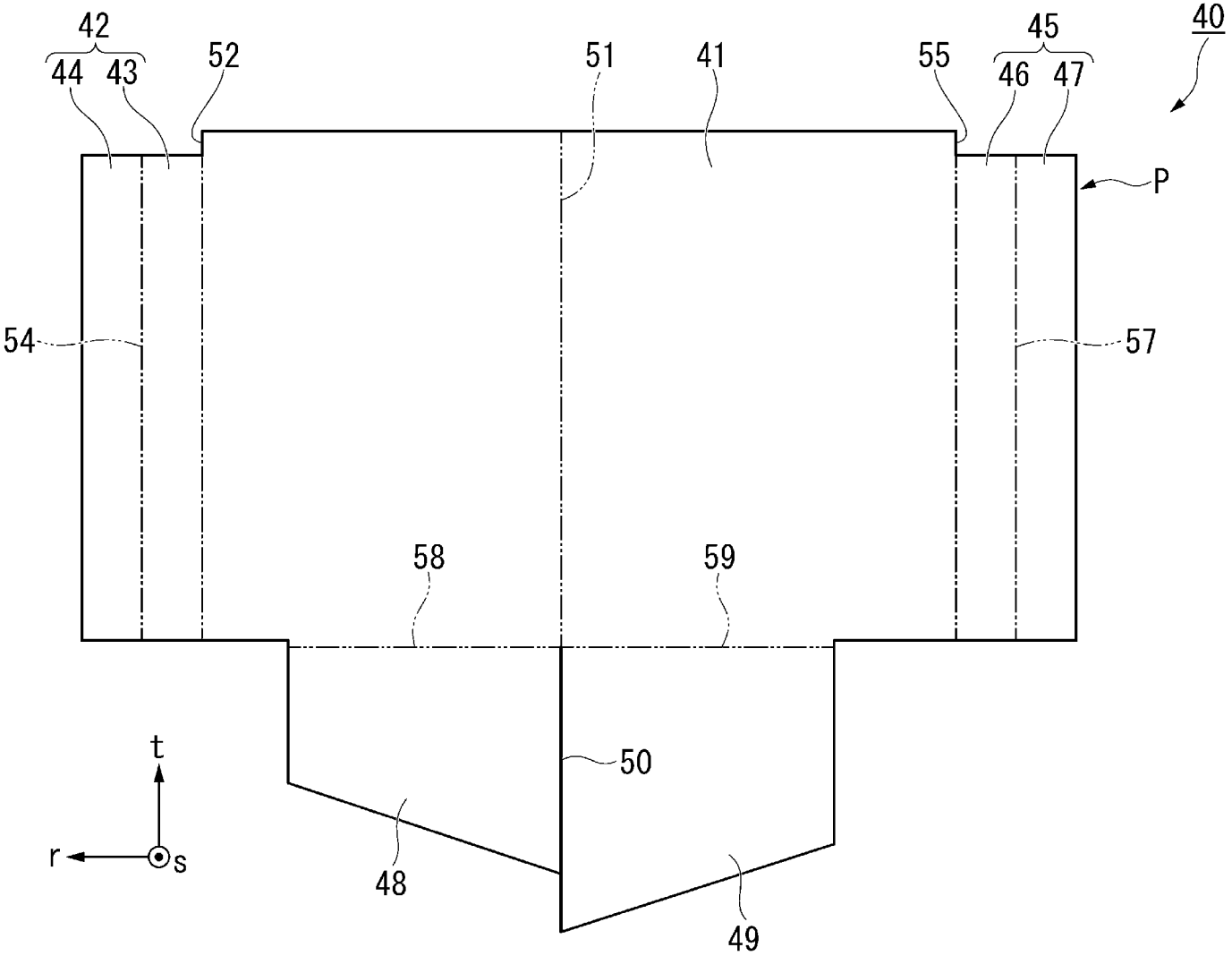
FIG. 5 is an exploded view illustrating the support device.

FIG. 5 is an exploded view illustrating the support device. The base member 41, the pair of tip members 42 and 45, and the pair of lower end members 48 and 49 of the support device 40 are formed of an integrated flat plate P.

The base endplate material 43 and the tip plate material 44 of the first tip member 42 are formed in the r direction next to the end portion of the base member 41 in the +r direction. At a polygonal line 54 between the base end plate material 43 and the tip plate material 44, the tip plate material 44 is folded in the −s direction to form the first tip member 42. The base end plate material 46 and the tip plate material 47 of the second tip member 45 are formed in the r direction next to the end portion of the base member 41 in the −r direction. At a polygonal line 57 between the base end plate material 46 and the tip plate material 47, the tip plate material 47 is folded in the +s direction to form the second tip member 45.

The pair of lower end members 48 and 49 are formed in the r direction next to an end portion of the base member 41 in a −t direction. A notch 50 is formed between the pair of lower end members 48 and 49. At a polygonal line 58 between the base member 41 and the first lower end member 48, the first lower end member 48 is folded in the −s direction to form the first lower end member 48. At a polygonal line 59 between the base member 41 and the second lower end member 49, the second lower end member 49 is folded in the +s direction to form the second lower end member 49.

The support device 40 according to the embodiment is formed by folding the integrated flat plate P. In the support device 40, an overlapping portion of a plurality of plate materials is not present. In the support device 40, a portion connected using an adhesive tape or the like is not present. Manufacturing costs including a material cost of the support device 40 are reduced. The support device 40 may be formed by connecting a plurality of separate flat plates.

As illustrated in FIGS. 3 and 9, if the large capacity paper feeding device 1 is packaged and conveyed, the support device 40 is disposed in the cassette 10.

The lower end portion of the base member 41 abuts against the upper surface of the tray 30 . The base member 41 is disposed substantially perpendicular to the upper surface of the tray 30.

The pair of tip members 42 and 45 are inserted into hole portions of the pair of first frames 12 and 15 facing each other in the front-rear direction. The pair of step portions 52 and 55 of the support device 40 are disposed adjacent to each other in the pair of first frames 12 and 15. The position of the support device 40 relative to the cassette 10 in the front-rear direction is restricted by the pair of step portions 52 and 55.

The first tip member 42 is inserted into a left front hole portion 13 on the left side among the pair of front hole portions 13 and 14 of the front frame 12. The second tip member 45 is inserted into a right rear hole portion 17 on the right side among the pair of rear hole portions 16 and 17 of the rear frame 15. The left front hole portion 13 and the right rear hole portion 17 are present near a diagonal line on the upper surface of the tray 30. The base member 41 intersects with the front-rear direction and is disposed near the diagonal line on the upper surface of the tray 30. Even when the front guide 22 and the rear guide 25 are disposed nearest to the center of the cassette 10, the base member 41 does not interfere with the front guide 22 and the rear guide 25.

a height from the lower end portion of the base member 41 to upper end portions of the pair of tip members 42 and 45 is the same as a height from the upper surface of the tray 30 to upper end portions of the hole portions 13 and 17 of the pair of first frames 12 and 15. The position of the support device 40 relative to the cassette 10 in the up-down direction is restricted by the pair of tip members 42 and 45.

As illustrated in FIG. 9, the pair of lower end members 48 and 49 are disposed along the upper surface of the tray 30. The tip sides 68 and 69 of the pair of lower end members 48 and 49 are disposed near the pair of second frames 18 and 19 facing each other in the left-right direction. The tip side 68 of the first lower end member 48 is disposed parallel to the left frame 18 to abut or be in contact with the left frame 18. The tip side 69 of the second lower end member 49 is disposed parallel to the right frame 19 to abut or be in contact with the right frame 19. The position of the support device 40 relative to the cassette 10 in the left-right direction is restricted by the pair of lower end members 48 and 49.

The right guide 29 of the sheet position adjustment mechanism 20 is disposed in a space between the end portion of the second lower end member 49 in the −r direction and the end portion of the base member 41 in the −r direction. Even when the right guide 29 is disposed nearest the center of the cassette 10, the second lower end member 49 does not interfere with the right guide 29.

Irrespective of the state of the sheet position adjustment mechanism 20, the position of the support device 40 relative to the cassette 10 in each of the directions is restricted. The movement of the tray 30 in the up-down direction is restricted by the support device 40. The tilt of the tray 30 is inhibited by the base member 41.

The first tip member 42 of the support device 40 in the +r direction is inserted into the left front hole portion 13 of the front frame 12 of the cassette 10. The tip side 68 of the first lower end member 48 of the support device 40 in the +r direction is disposed near the left frame 18 of the cassette 10. A length from the lower end portion of the base member 41 to the tip side 68 decreases, and the material cost of the support device 40 is reduced. The second tip member 45 of the support device 40 in the −r direction is inserted into the right rear hole portion 17 of the rear frame 15 of the cassette 10. The tip side 69 of the second lower end member 49 of the support device 40 in the −r direction is disposed near the right frame 19 of the cassette 10. A length from the lower end portion of the base member 41 to the tip side 69 decreases, and the material cost of the support device 40 is reduced.

A method of mounting the support device 40 on the cassette 10 will be described.

Figure 6:
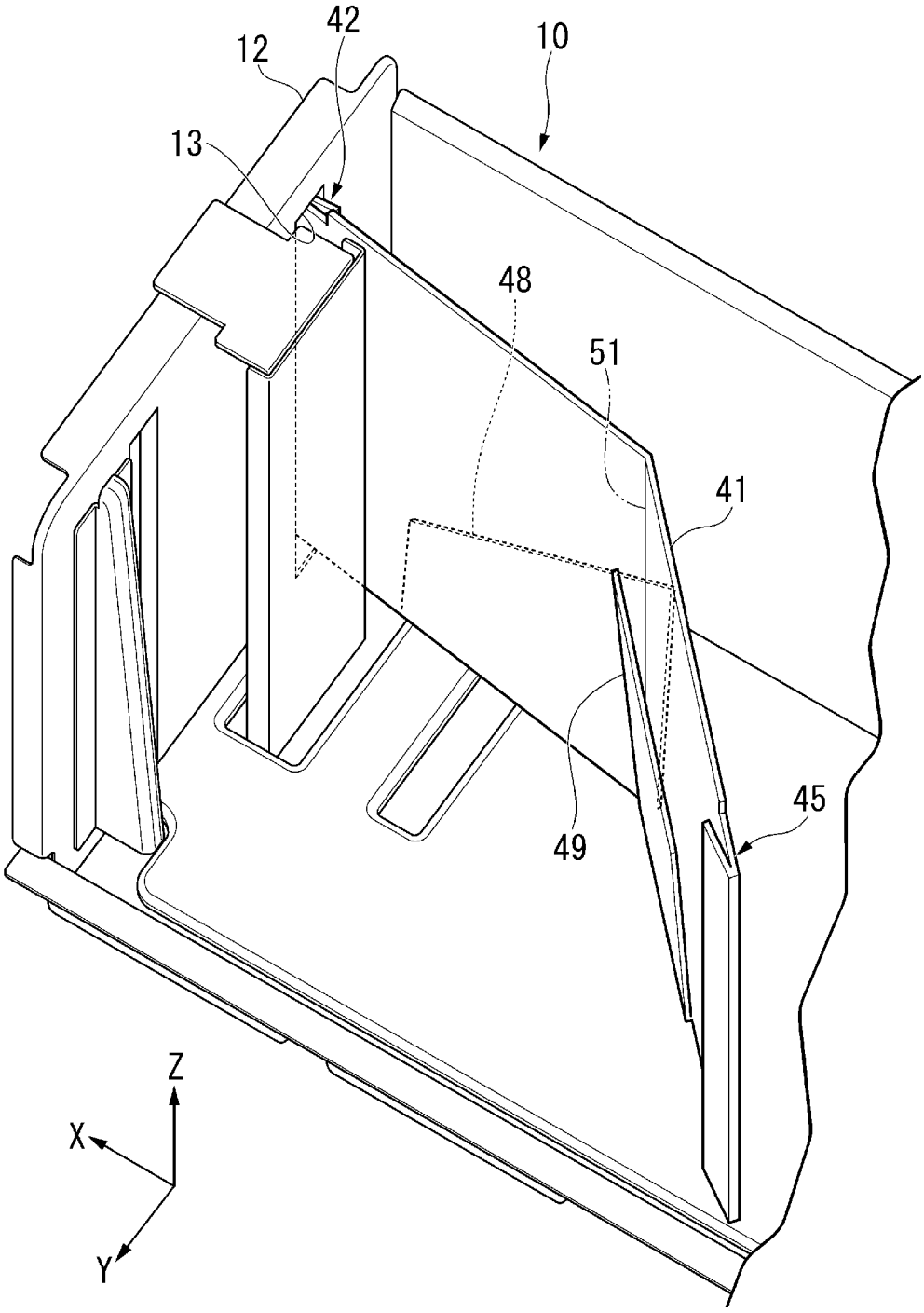
FIG. 6 is a first diagram illustrating a method of mounting the support device on a cassette.
Figure 7:
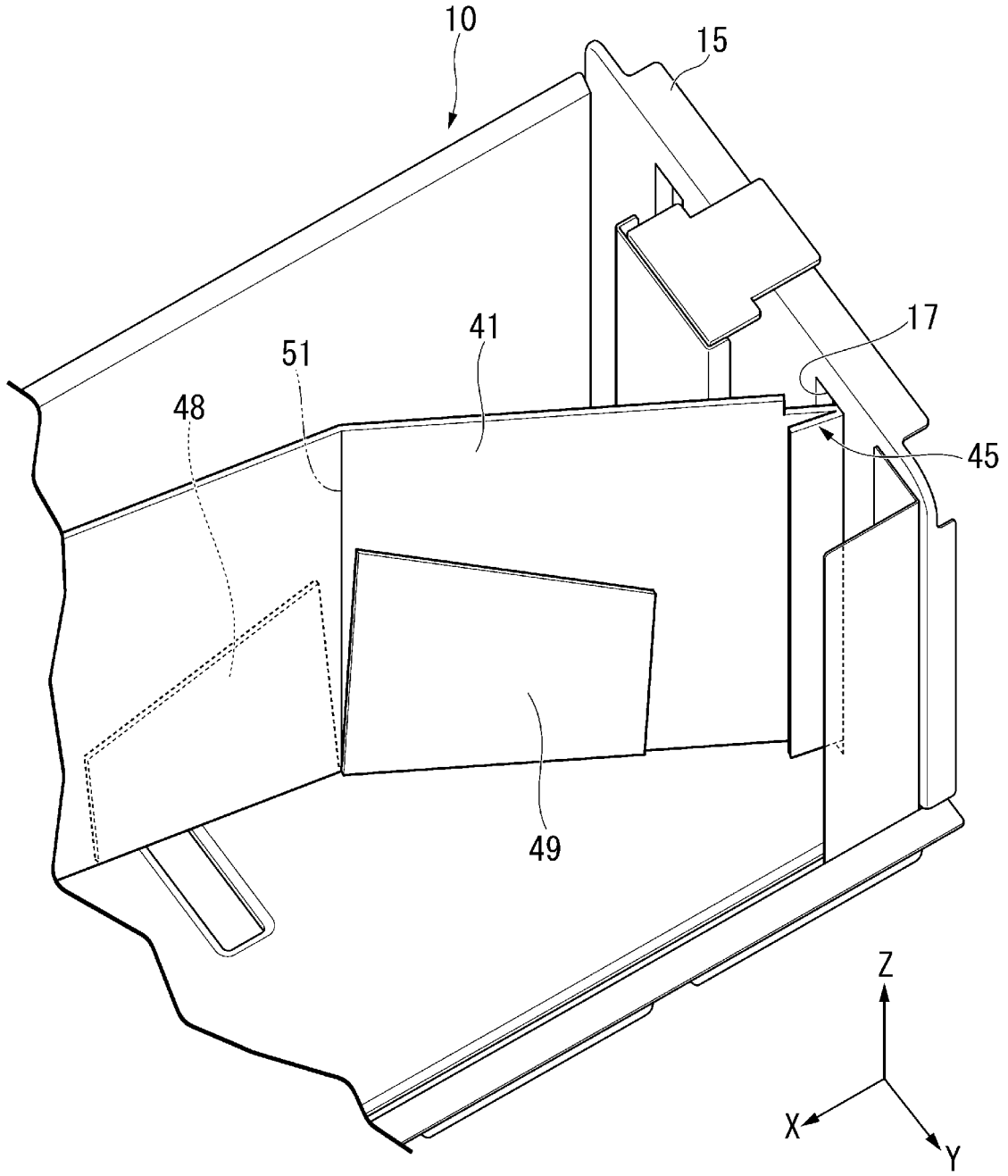
FIG. 7 is a second diagram illustrating the method of mounting the support device on the cassette.

FIGS. 6 to 9 are first to fourth diagrams illustrating the method of mounting the support device on the cassette. As illustrated in FIG. 6, the pair of lower end members 48 and 49 are folded up to the surface of the base member 41. The base member 41 is folded at the polygonal line 51. The first tip member 42 is inserted into the left front hole portion 13 of the front frame 12. As illustrated in FIG. 7, the second tip member 45 is inserted into the right rear hole portion 17 of the rear frame 15. The pair of lower end members 48 and 49 and the base member 41 are folded and thus do not interfere with the respective frames of the cassette 10. The pair of tip members 42 and 45 are easily inserted into the hole portions 13 and 17 of the pair of first frames 12 and 15.

Figure 8:
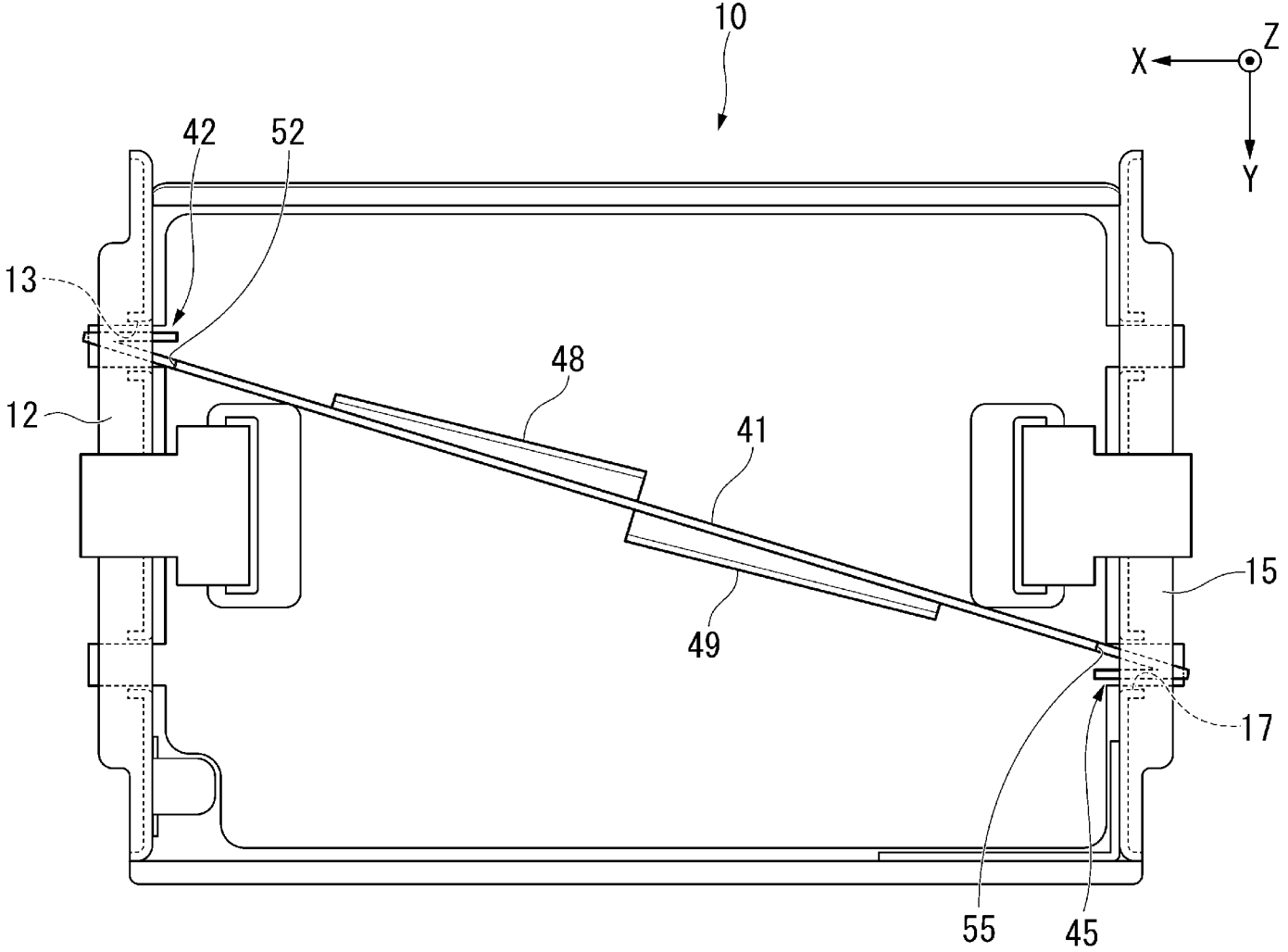
FIG. 8 is a third diagram illustrating the method of mounting the support device on the cassette.

As illustrated in FIG. 8, the folded base member 41 is returned to the flat plate shape. The pair of tip members 42 and 45 are inserted deep into the hole portions 13 and 17 of the pair of first frames 12 and 15. The pair of step portions 52 and 55 of the base member 41 are disposed near the first frames 12 and 15. As illustrated in FIG. 9, the pair of folded lower end members 48 and 49 are exploded at the substantially right angle with respect to the base member 41. The tip sides 68 and 69 of the pair of lower end members 48 and 49 are disposed near the pair of second frames 18 and 19.

As a result, the mounting of the support device 40 on the cassette 10 is completed.

As described above in detail, the support device 40 according to the embodiment includes the base member 41, the pair of tip members 42 and 45, and the pair of lower end members 48 and 49. The base member 41 is configured to be foldable at an intermediate portion in the r direction, the base member having a plate shape. The pair of tip members 42 and 45 are present in both end portions of the base member 41 in the r direction and have a configuration where a pair of plate materials are disposed to be tapered. The pair of lower end members 48 and 49 have a plate shape, are present in the lower end portion of the base member 41 on both sides of the base member 41 in the s direction, and form a substantially right angle with the base member 41.

The support device 40 supports the tray 30 present in the cassette 10 of the large capacity paper feeding device 1. The lower end portion of the base member 41 abuts against the upper surface of the tray 30. The pair of tip members 42 and 45 are inserted into the hole portions 13 and 17 of the pair of first frames 12 and 15 facing each other in the front-rear direction in the cassette 10. The tip sides of the pair of lower end members 48 and 49 are disposed near the pair of second frames 18 and 19 facing each other in the left-right direction in the cassette 10.

The base member 41 is disposed between the pair of first frames 12 and 15 such that the position of the support device 40 relative to the cassette 10 in the front-rear direction is restricted. The tip sides 68 and 69 of the pair of lower end members 48 and 49 are disposed near the pair of second frames 18 and 19 such that the position of the support device 40 relative to the cassette 10 in the left-right direction is restricted. The pair of tip members 42 and 45 are inserted into the hole portions 13 and 17 such that the position of the support device 40 relative to the cassette 10 in the up-down direction is restricted. The lower end portion of the support device 40 abuts against the upper surface of the tray 30 present in the bottom portion of the cassette 10 such that the movement and tilt of the tray 30 in the up-down direction are inhibited. The support device 40 can restrict the movement of the tray 30. The movement of the tray 30 is restricted such that damages of the tray 30 and the peripheral members of the tray 30 are reduced. In particular, damages of the front pins 33 and 34 and the rear pins 36 and 37 connected to the tray 30 are reduced.

The base member 41, the pair of tip members 42 and 45, and the pair of lower end members 48 and 49 are formed of the integrated flat plate P.

The manufacturing costs of the support device 40 are reduced.

The height from the lower end portion to the upper end portion of the base member 41 is higher than the height from the lower end portion of the base member 41 to the upper end portions of the pair of tip members 42 and 45.

The pair of step portions 52 and 55 are present between the upper end portion of the base member 41 and the upper end portions of the pair of tip members 42 and 45. The pair of step portions 52 and 55 are disposed between the pair of first frames 12 and 15 such that the position of the support device 40 relative to the cassette 10 in the front-rear direction is restricted.

The pair of lower end members 48 and 49 are the first lower end member 48 present in the +r direction of the base member 41 and the second lower end member 49 present in the −r direction of the base member 41. The tip side 68 of the first lower end member 48 and the tip side 69 of the second lower end member 49 are parallel to each other.

The tip sides 68 and 69 of the pair of lower end members 48 and 49 are disposed parallel to the pair of second frames 18 and 19 such that the position of the support device 40 relative to the cassette 10 in the left-right direction is restricted.

The tip side 68 of the first lower end member 48 and the tip side 69 of the second lower end member 49 are not parallel to the base member 41.

The base member 41 is not parallel to the front-rear direction. The base member 41 is disposed near the diagonal line on the upper surface of the tray 30. The tilt of the tray 30 is inhibited by the base member 41 such that the movement of the tray 30 is restricted. The interference between the base member 41 and the front guide 22 and the rear guide 25 of the sheet position adjustment mechanism 20 is avoided.

The end portion of the first lower end member 48 in the +r direction is present in the −r direction further than the end portion of the base member 41 in the +r direction. The end portion of the second lower end member 49 in the −r direction is present in the +r direction further than the end portion of the base member 41 in the −r direction.

The right guide 29 of the sheet position adjustment mechanism 20 is disposed in the space between the end portion of the second lower end member 49 in the −r direction and the end portion of the base member 41 in the −r direction. The interference between the second lower end member 49 and the right guide 29 is avoided.

The height from the lower end portion of the base member 41 to the upper end portions of the pair of tip members 42 and 45 is the same as the height from the upper surface of the tray 30 to the upper end portions of the hole portions 13 and 17.

The lower end portion of the base member 41 abuts against the upper surface of the tray 30. The pair of tip members 42 and 45 are inserted into the hole portions 13 and 17. The position of the support device 40 relative to the cassette 10 in the up-down direction is restricted such that the movement of the tray 30 in the up-down direction is restricted.

The hole portions 13 and 17 are long in the up-down direction, the pins 33 and 37 connected to the tray 30 are inserted into the hole portions 13 and 17, and the hole portions 13 and 17 guide the movement of the tray 30 in the up-down direction.

The pair of tip members 42 and 45 are inserted into the hole portions 13 and 17 that are long in the up-down direction such that the posture of the support device 40 is stabilized. The movements of the pins 33 and 37 inserted into the hole portions 13 and 17 in the up-down direction are restricted by the pair of tip members 42 and 45 such that damages of the pins 33 and 37 are reduced.

The hole portions 13 and 17 are present near both end portions of the diagonal line on the upper surface of the tray 30.

The pair of tip members 42 and 45 are inserted into the hole portions 13 and 17, and the base member 41 is disposed near the diagonal line of the tray 30. The tilt of the tray 30 is inhibited by the base member 41 such that the movement of the tray 30 is restricted. The interference between the base member 41 and the front guide 22 and the rear guide 25 of the sheet position adjustment mechanism 20 is avoided.

The large capacity paper feeding device 1 to which the support device according to the embodiment is mounted supplies sheets to the image forming apparatus 100 that is an example of the image processing apparatus. The large capacity paper feeding device 1 may supply sheets to a decoloring apparatus that is another example of the image processing apparatus. The decolor apparatus executes a process of decoloring (erasing) an image formed on a sheet by a decolorable toner.

The large capacity paper feeding device 1 to which the support device 40 according to the embodiment is mounted is disposed on the right side of the image forming apparatus 100. The large capacity paper feeding device may be disposed on the left side of the image forming apparatus. In this case, the large capacity paper feeding device and the support device are reverse to the large capacity paper feeding device 1 and the support device 40 according to the embodiment in the left-right direction. The large capacity paper feeding device 1 may be disposed on a side other than the right side and the left side of the image forming apparatus 100.

The first tip member 42 of the support device 40 according to the embodiment is inserted into the left front hole portion 13 of the cassette 10, and the second tip member 45 of the support device 40 according to the embodiment is inserted into the right rear hole portion 17 of the cassette 10. The first tip member of the support device may be inserted into the right front hole portion 14 of the cassette 10, and the second tip member may be inserted into the left rear hole portion 16 of cassette 10. In this case, the support device is reverse to the support device 40 according to the embodiment in the s direction.

According to any one of the embodiments described above, the support device 40 includes the base member 41, the pair of tip members 42 and 45, and the pair of lower end members 48 and 49. As a result, the movement of the tray 30 can be restricted.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. A support device, comprising:

a base member configured to fold at an intermediate portion in a width direction, the base member having a plate shape;

a pair of tip members in both end portions of the base member in the width direction respectively having a pair of plate materials disposed to be tapered; and a pair of lower end members having a plate shape, present in a lower end portion of the base member on both sides of the base member in a thickness direction, the pair of lower end members forming a substantially right angle with the base member.

2. The support device according to claim 1, wherein the base member, the pair of tip members, and the pair of lower end members are formed of an integrated flat plate.

3. The support device according to claim 1, wherein a height from the lower end portion to an upper end portion of the base member is higher than a height from the lower end portion of the base member to upper end portions of the pair of tip members.

4. The support device according to claim 1, wherein the pair of lower end members are a first lower end member in a first direction of the width direction of the base member and a second lower end member in a second direction of the width direction of the base member, and a tip side of the first lower end member and a tip side of the second lower end member are parallel to each other.

5. The support device according to claim 4, wherein the tip side of the first lower end member and the tip side of the second lower end member are not parallel to the base member.

6. The support device according to claim 4, wherein an end portion of the first lower end member in the first direction is in the second direction further than an end portion of the base member in the first direction, and an end portion of the second lower end member in the second direction is in the first direction further than an end portion of the base member in the second direction.

7. The support device according to claim 1, wherein the support device supports a tray in a bottom portion of a cassette of a large capacity paper feeding device, the lower end portion of the base member abuts against an upper surface of the tray, the pair of tip members are inserted into hole portions of a pair of first frames facing each other in a third direction in the cassette, and tip sides of the pair of lower end members are disposed near a pair of second frames facing each other in a fourth direction that is perpendicular to the third direction in the cassette.

8. The support device according to claim 7, wherein a height from the lower end portion of the base member to upper end portions of the pair of tip members is the same as a height from the upper surface of the tray to upper end portions of the hole portions.

9. The support device according to claim 7, wherein the hole portions are longer in an up-down direction than in a side to side direction, pins connected to the tray are inserted into the hole portions, and the hole portions guide a vertical movement of the tray.

10. The support device according to claim 7, wherein the hole portions are near both end portions of a diagonal line on the upper surface of the tray.

11. A preprocessing device for image forming apparatus, comprising:

a base member configured to fold at an intermediate portion in a width direction, the base member having a plate shape;

a pair of tip members in both end portions of the base member in the width direction respectively having a pair of plate materials disposed to be tapered; and a pair of lower end members having a plate shape, present in a lower end portion of the base member on both sides of the base member in a thickness direction, the pair of lower end members forming a substantially right angle with the base member.

12. The preprocessing device according to claim 11, wherein the base member, the pair of tip members, and the pair of lower end members are formed of an integrated flat plate.

13. The preprocessing device according to claim 11, wherein a height from the lower end portion to an upper end portion of the base member is higher than a height from the lower end portion of the base member to upper end portions of the pair of tip members.

14. The preprocessing device according to claim 11, wherein the pair of lower end members are a first lower end member in a first direction of the width direction of the base member and a second lower end member in a second direction of the width direction of the base member, and a tip side of the first lower end member and a tip side of the second lower end member are parallel to each other.

15. The preprocessing device according to claim 14, wherein the tip side of the first lower end member and the tip side of the second lower end member are not parallel to the base member.

16. The preprocessing device according to claim 14, wherein an end portion of the first lower end member in the first direction is in the second direction further than an end portion of the base member in the first direction, and an end portion of the second lower end member in the second direction is in the first direction further than an end portion of the base member in the second direction.

17. An image forming apparatus, comprising:

an image forming section; and a paper holding section comprising:

a base member configured to fold at an intermediate portion in a width direction, the base member having a plate shape;

a pair of tip members in both end portions of the base member in the width direction respectively having a pair of plate materials disposed to be tapered; and a pair of lower end members having a plate shape, present in a lower end portion of the base member on both sides of the base member in a thickness direction, the pair of lower end members forming a substantially right angle with the base member, wherein the paper holding section supports a tray in a bottom portion of a cassette of a large capacity paper feeding device, the lower end portion of the base member abuts against an upper surface of the tray, the pair of tip members are inserted into hole portions of a pair of first frames facing each other in a third direction in the cassette, and tip sides of the pair of lower end members are disposed near a pair of second frames facing each other in a fourth direction that is perpendicular to the third direction in the cassette.

18. The image forming apparatus according to claim 17, wherein a height from the lower end portion of the base member to upper end portions of the pair of tip members is the same as a height from the upper surface of the tray to upper end portions of the hole portions.

19. The image forming apparatus according to claim 17, wherein the hole portions are longer in an up-down direction than in a side to side direction, pins connected to the tray are inserted into the hole portions, and the hole portions guide a vertical movement of the tray.

20. The image forming apparatus according to claim 17, wherein the hole portions are near both end portions of a diagonal line on the upper surface of the tray.

* * * * *